US005941001A

United States Patent [19]

Dietrich et al.

[11] Patent Number: 5,941,001

[45] Date of Patent: Aug. 24, 1999

[54] DEVICE FOR ACCOMODATING A PLANIFORM ADVERTISING CARRIER

[76] Inventors: Thomas Dietrich, Hauptstr. 63; Rainer Kunze, Hauptstr. 107 a, both of D-37318 Lutter; Michael Lazar, Herwigsmühlenweg 3 c, D-34123 Kassel, all of Germany

[21] Appl. No.: 08/879,412

[22] Filed: Jun. 20, 1997

[30] Foreign Application Priority Data

Oct. 23, 1995 [DE] Germany ..... 95 01468

[51] Int. Cl.[6] ..... G09F 17/00

[52] U.S. Cl. ..... 40/603; 40/601; 160/338; 160/339

[58] Field of Search ..... 40/601, 603, 604; 160/333, 338, 339

[56] References Cited

U.S. PATENT DOCUMENTS

| | | | |
|---|---|---|---|
| 2,125,994 | 8/1938 | Doering | 40/601 X |
| 2,591,494 | 4/1952 | Asachika | 40/601 |
| 3,434,685 | 3/1969 | Gorgone | 160/338 |
| 3,673,720 | 7/1972 | Thornton | 40/601 |
| 4,368,586 | 1/1983 | Forzelias . | |
| 4,459,773 | 7/1984 | Sandlin et al. | 40/603 X |
| 5,438,780 | 8/1995 | Winner | 40/601 X |

FOREIGN PATENT DOCUMENTS

| | | |
|---|---|---|
| 0331853 | 9/1989 | European Pat. Off. . |
| 9420817 | 3/1995 | Germany . |

*Primary Examiner*—Michael F. Trettel
*Assistant Examiner*—Robert G. Santos
*Attorney, Agent, or Firm*—Thomas R. Vigil

[57] ABSTRACT

Device for accommodating a planiform advertising carrier, for example an advertising carrier consisting of foil or similar material. The advertising carrier is tenterable between two bars (5, 6) whereas the bars (5, 6) are relative to each other movably accommodated by a frame (2).

11 Claims, 11 Drawing Sheets

DEVICE FOR ACCOMODATING A PLANIFORM ADVERTISING CARRIER

BACKGROUND OF THE INVENTION

1. Field of the Invention

The invention concerns a device for accommodating a planiform advertising carrier, for example an advertising carrier consisting of foil or similar material. The advertising carrier is tenterable between two bows whereas the bows are relative to each other movably accommodated by a frame.

2. Description of the Prior Art

Many different versions of large planiform advertising carriers are known; placard walls are known for example that can be placed onto house walls. Another well-known procedure also used in advertising is to provide complete house walls with appropriate colour ads. Electrical advertising carriers designed as illuminated advertising panels are known too. All these well-known advertising carriers have many different disadvantages. Placard walls particularly have an advertising picture that inconveniently is composed of several individual segments. The outer appearance and thus the quality of the placard mainly depends on the person who fixes the placard onto the placard wall. Moreover, a considerable amount of time is needed to glue a large placard, whereas the safety risk incurred by the person gluing large, i.e. also high placard walls, is not to be forgotten. Moreover, gluing large placards requires considerable technical efforts, since even lift scaffolds may be necessary.

Panels with luminous advertisings are very expensive. This entails that the advertising is not changed very often; the same applies to painted house walls.

EP A 0 331 853 discloses a frame that accommodates a planiform advertising carrier. This frame has a predetermined size and cannot accommodate advertising carriers of different sizes.

A device of the type mentioned above is known out of U.S. Pat. No. 4,368,586. This device provides a frame with two horizontally running bows, whereas one of the two bows is movably guided through two parallel frame tubes. One of the bows is movably arranged onto the frame and is fastened onto the frame tubes by means of a clamping device. Hereby the advertising carrier is fastened onto the upper bow and tentered downwards. That means that, for a change of the advertising carrier, the upper bow has to be accessible. The change of an advertising carrier in such a frame is difficult though when the planiform advertising carrier is extending far in a vertical direction, the upper bow being then difficult to reach. That means that the device known from this U.S. Pat. No. 4,368,586 is appropriate for accommodating planiform advertising carriers, whereas they should not be too big, especially in height, since otherwise the change of an advertising carrier implies quite complicated measures.

SUMMARY OF THE INVENTION

The object of the present invention is therefore to provide a device for accommodating a planiform advertising carrier, the advertising carrier being tenterable between two bows whereas the bows are relative to each other movably accommodated by a frame, the device allowing an easy change of the advertising carrier even in case the advertising carrier has a big vertical extension.

The solution of this object is to keep the bow tentered against the tentering direction by means of a stopper.

Thus, the lower bow can be used to accommodate the advertising carrier and the upper bow can be designed so as to be adjustable in height whereas after accommodation of the advertising carrier and thus after moving the bow vertically into a predetermined final position, the lower bow that accommodates the advertising carrier is kept tentered against the tentering direction by means of the stopper, so that the planiform advertising carrier, gripped between the two bows always stands under a tension responsible for a crease-free appearance of the advertising carrier. The stopper is preferrably designed as a spring-loaded stopper in order to keep the advertising carrier tentered.

The bows, running horizontally, can be received by the frame and the advertising carrier is placed between the two bows and tentered by them. A tentering device is provided for tentering the advertising carrier, for example a cable winch with a cable pull, the cable pull being connected with at least one of the bows that is moved away from the other bow in the frame. The frame itself consists of two, particularly vertically running guiding elements for receiving the bows, whereas the bow is provided at each end with a reeling device in order to avoid a jam of the bow during the tentering procedure, the reeling device being guided movably through the guiding element.

In order to secure the advertising carrier in its gripped position, securing means are provided to secure one of the bows of the advertising carrier. The securing means comprises particularly a spring-loaded bolt that can be removably inserted into the bow. The bow advantageously is provided with an eye having an oblique inlet for the bolt, so that the bolt automatically runs into the opening when the bow reaches the area of the bolt.

Another securing means is characterized by a lever being pivotable into the guiding element, which prevents the reeling device and the upper bow from unintentionally running down along the two guiding elements.

The security against unintended reeling down of the reeling device is increased by maintaining the lever pressed into the guiding element by the spring's load. Accordingly, pulling means are provided to draw the lever out of the area of the guiding element against the spring's force.

BRIEF DESCRIPTION OF THE DRAWINGS

FIG. 8*a* to

DESCRIPTION OF THE PREFERRED EMBODIMENT(S)

Figure 1:
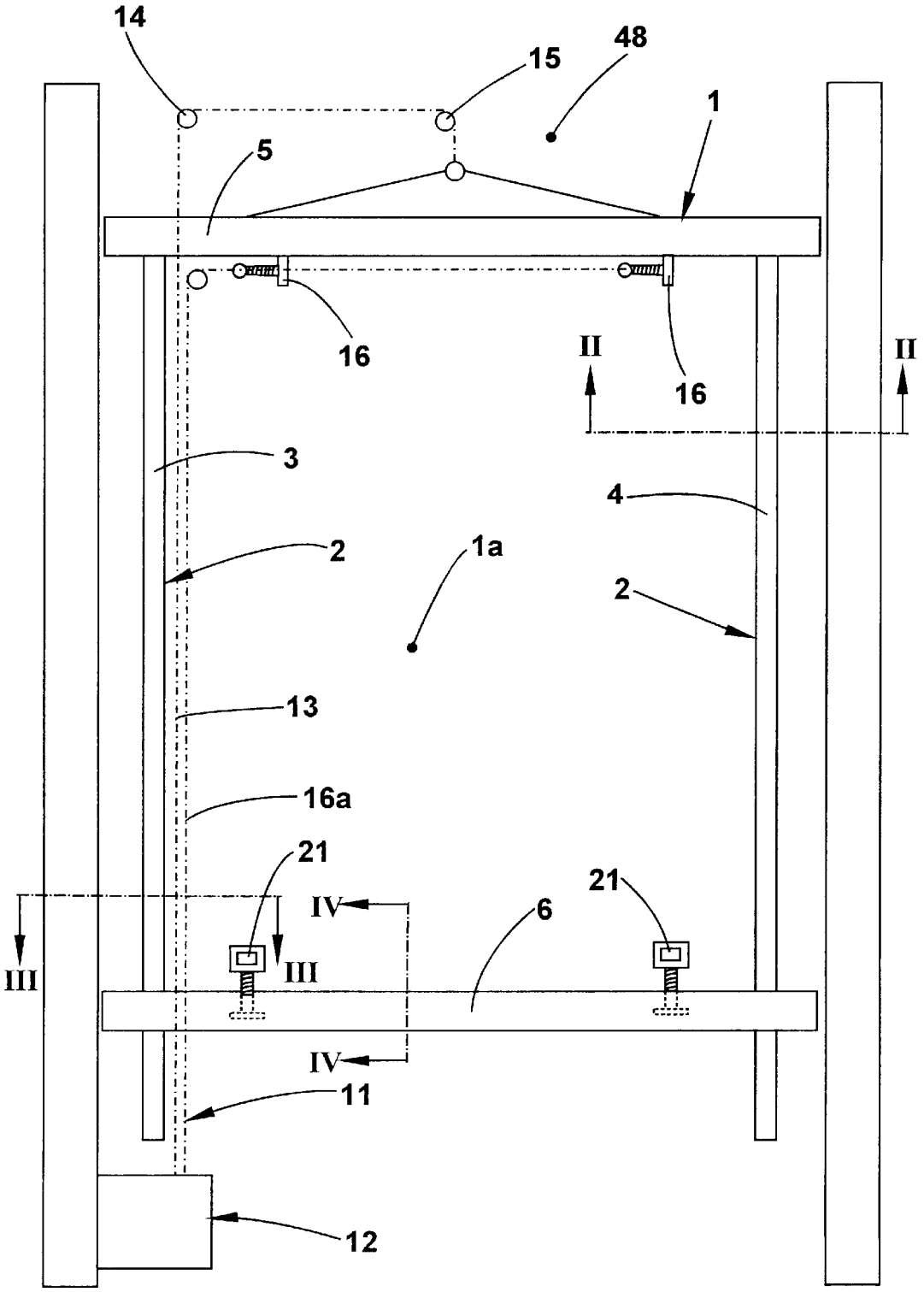
FIG. 1 is a front view of the device in a first embodiment.

According to FIG. 1, the device for accommodating a planiform advertising carrier 1*a*, referred to in its whole with numeral 1, is provided with a frame, referred to in its whole with numeral 2, the frame being arranged on a house wall 48. The frame 2 consists of the two vertical guiding elements 3 and 4 running parallely to each other and through which the bars 5 and 6 are guided. The guiding elements 3 and 4 have a more or less c-shaped section (FIG. 2, FIG. 3) for receiving the bars, whereas the more or less c-shaped section receives the reeling device 7 resp. 8. The reeling device comprises an angle 10, connecting the reeling device with the bar 5, 6.

Figure 2:
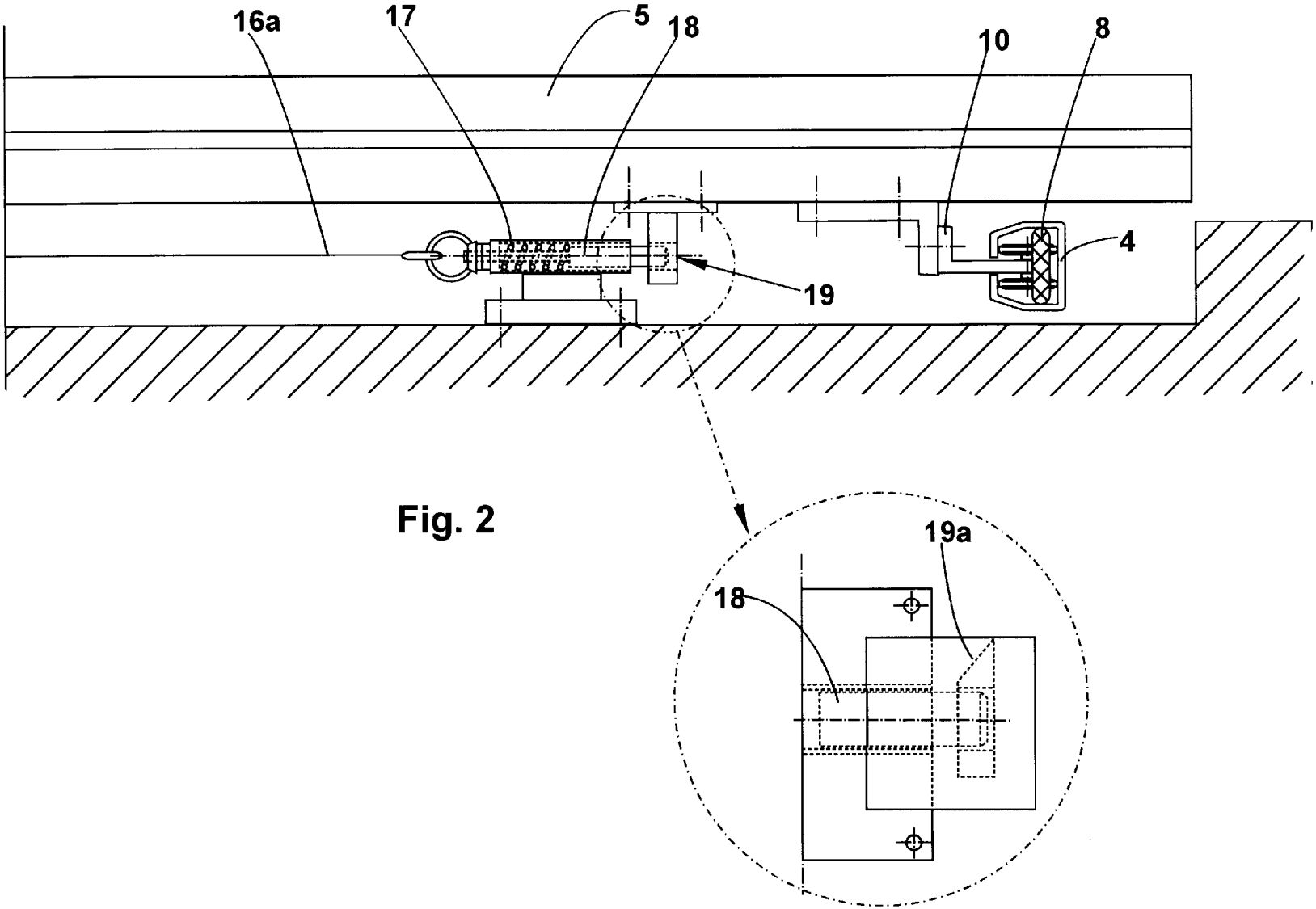
FIG. 2 is a section along the line II—II.
Figure 3:
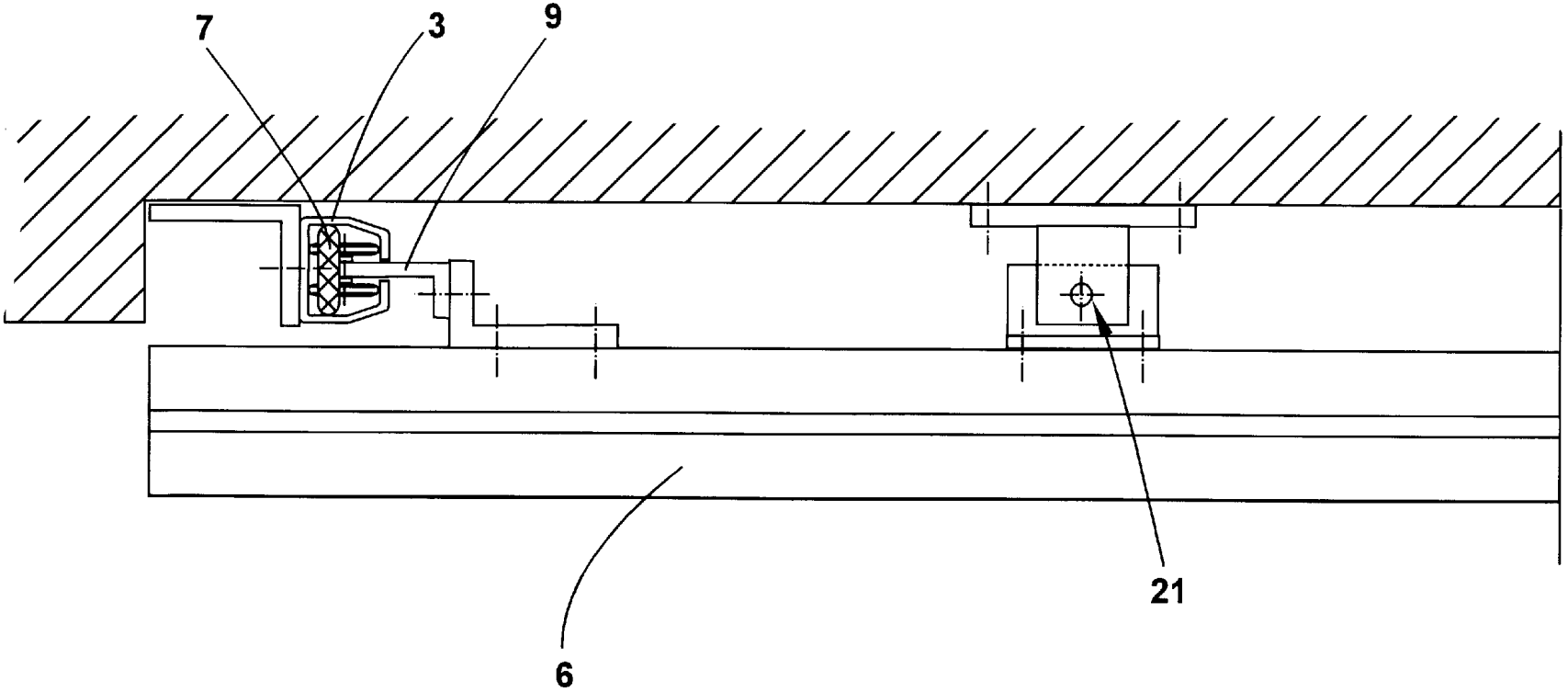
FIG. 3 is a section along the line III—III of FIG. 1.

A tentering device referred to in its whole with numeral 11 is provided for lifting the bar 5. The tentering device comprises a cable winch 12 to receive the cable 13, the cable being connected with the bar 5 via deflection rollers 14 and 15 fastened onto the house wall 48. Securing means 16 are provided in order to secure the bar 5 when the advertising carrier is tentered (FIG. 2). The securing means 16 comprises a bolt 18 loaded on either side of the guiding elements with a spring 17, whereas the bolt can be engaged with the eye 19 placed on the bar 5. To make sure that the bolt 18 automatically runs into the eye, the eye is provided on its lower edge with an oblique inlet 19*a*. Another possibility could be to provide the bolt 18 with a slanted opening on the side of the eye so that it can automatically run into the eye 19. To take the bolt 18 out of the eye 19, the releasing cable 16*a* pulls the bolt 18 against the spring's 17 force out of the area of the eye 19.

Figure 4:
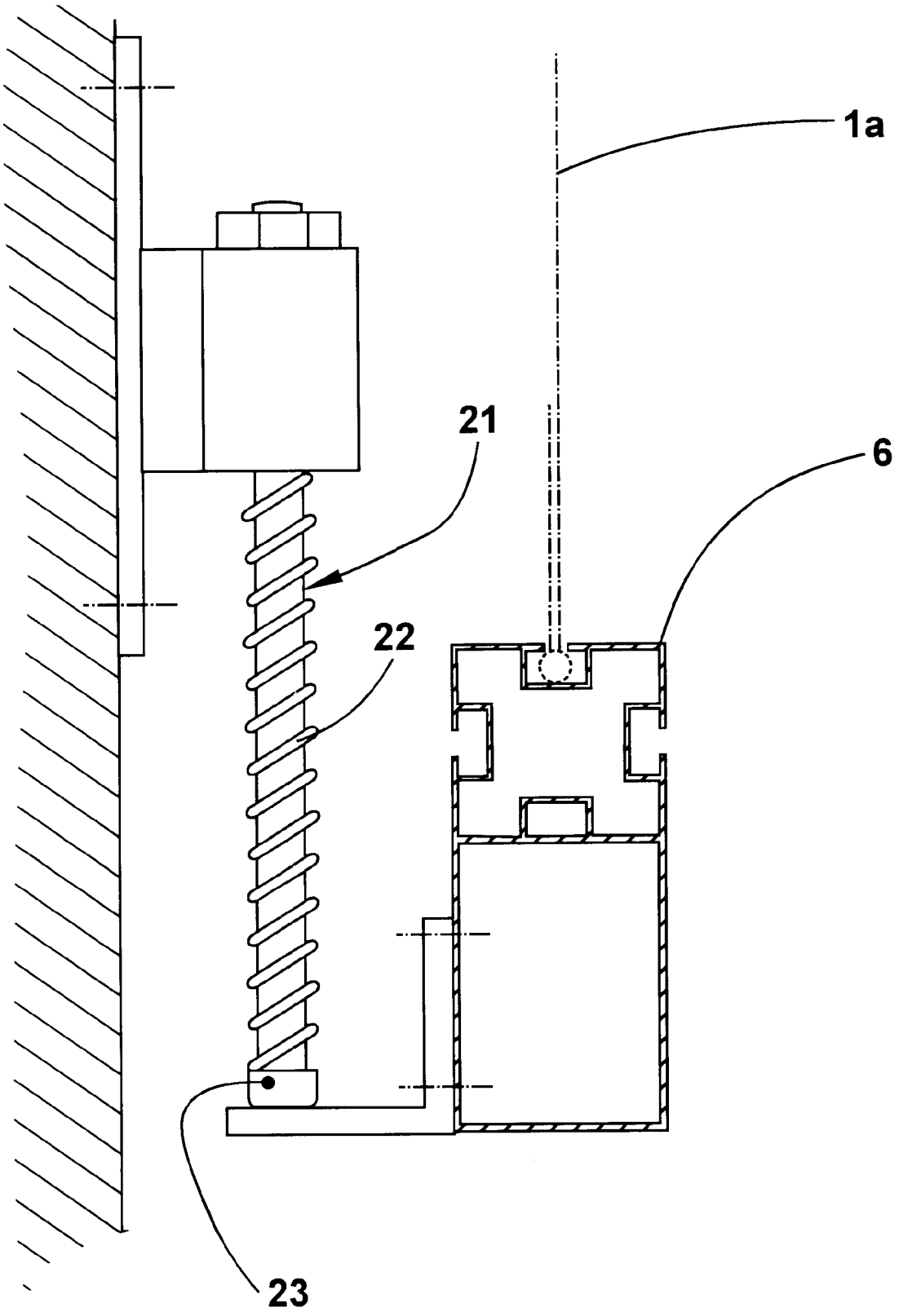
FIG. 4 is a section along the line IV—IV of FIG. 1.
Figure 5:
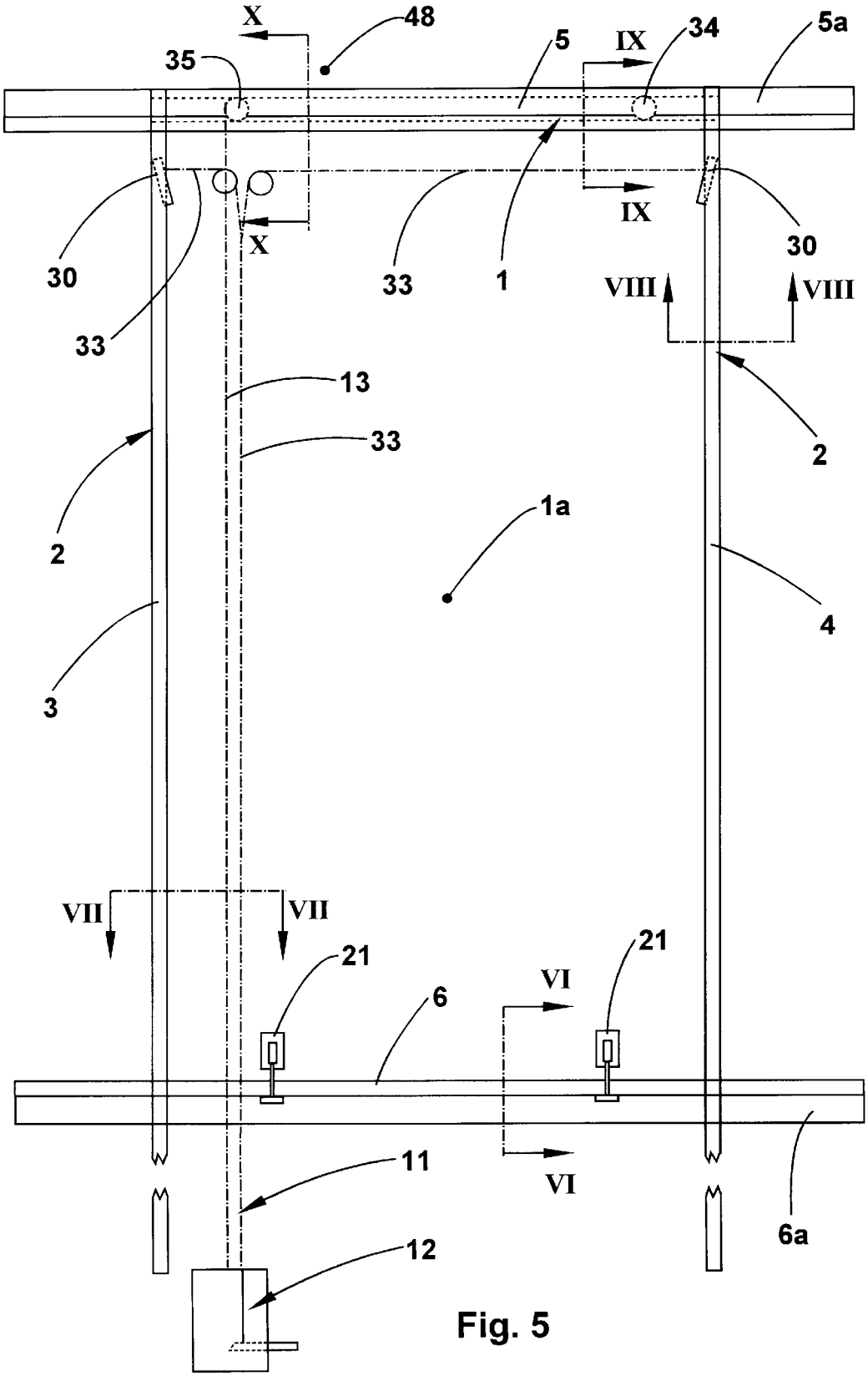
FIG. 5 is a front view of the device in a second embodiment.
Figure 6:
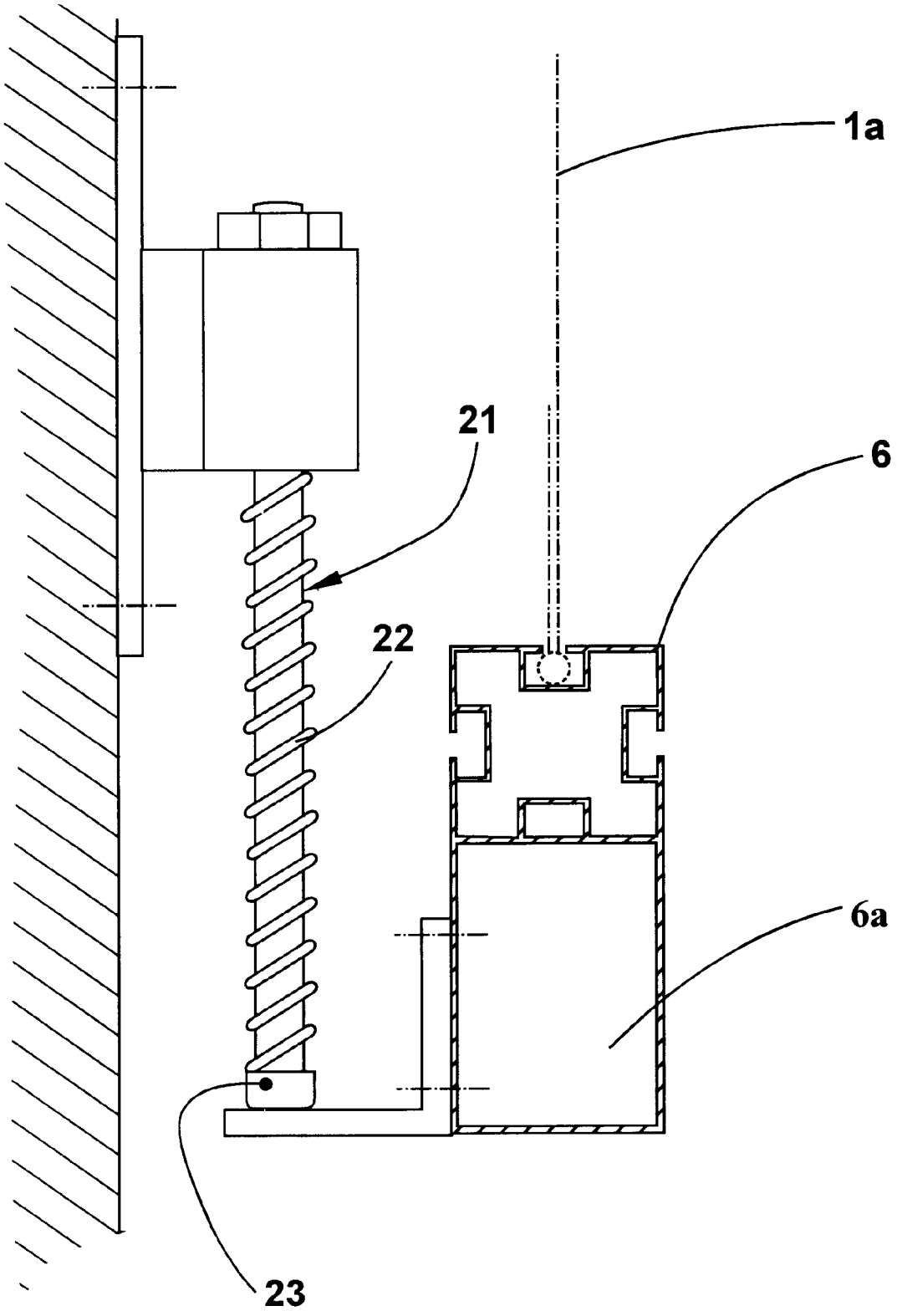
FIG. 6 is a section along the line VI—VI of FIG. 5.
Figure 7:
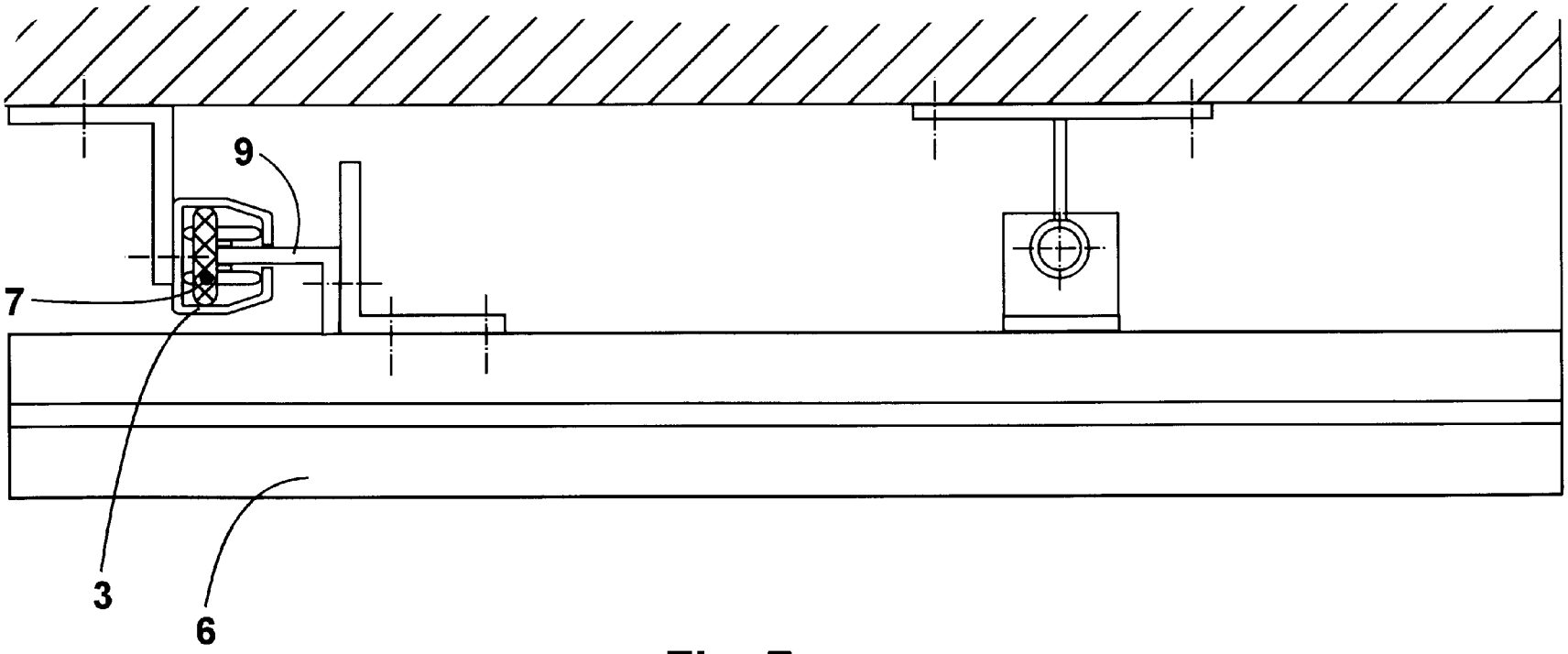
FIG. 7 is a section along the line VII—VII of FIG. 5 in a different projection.
Figure 8A:
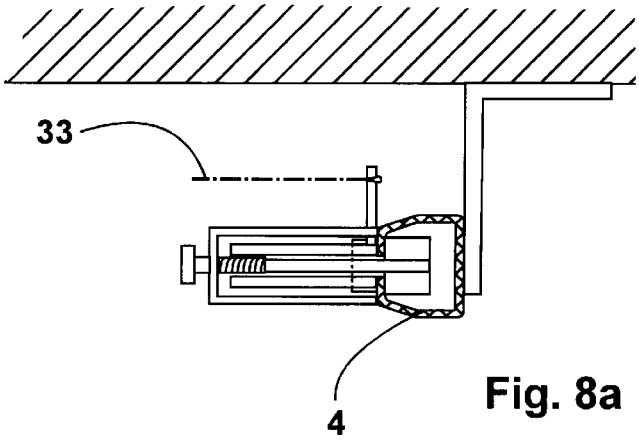
Figure 8B:
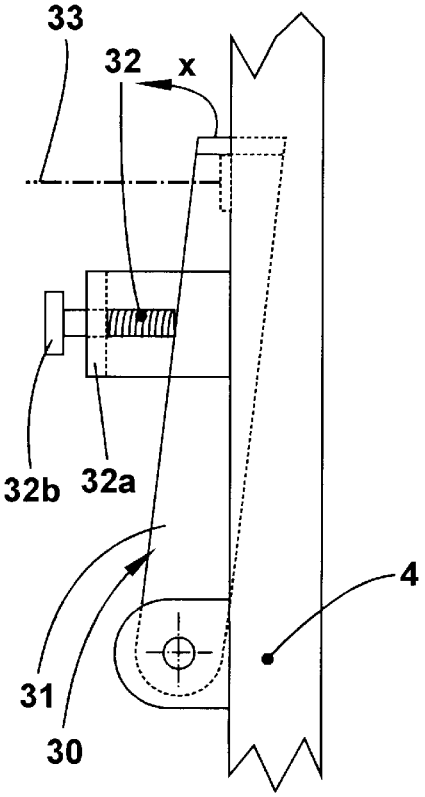
Figure 8C:
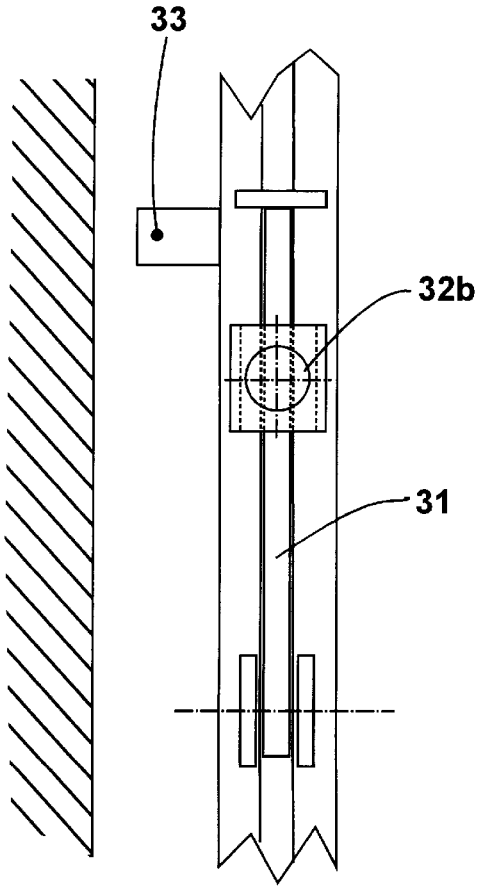
FIG. 8*c* is a section along the line VIII—VIII of FIG. 5 in a different projection.

The bar 6 is held by two stoppers 21 (FIG. 4). The stopper 21 comprises a bolt 23 being biased by the spring 22 which exerts its action onto the bar 6 from the top. It is necessary to design the stopper 21 as a spring-loaded stopper in order to ensure that the advertising carrier 1*a* remains tentered between the bars 5, 6.

The second embodiment according to FIG. 5–FIG. 10*b* only differs from the first embodiment by the design of the securing means and by the location of the two reels 34 and 35, so that the bar 5 can be pulled vertically upwards. Moreover both bars 5 and 6 have a cleat 5*a* and 6*a* resp. The design of the securing means 30 can be seen in FIGS. 8*a* to 8*c*; the securing means 30 consists of the pivoting lever 31 placed onto the guiding element 3, 4 and being biased by the spring 32. This spring 32 is located in a housing 32*a*, whereas the housing 32*a* receives a bolt 32*b* moving axially, the bolt 32*b* being used to guide the spring 32. On its upper end, the lever 32 is connected with the pulling means 33, for example with a cable, whereas the lever 31 can be pivoted out of the guiding element 3, 4 in direction of the arrow x by the pulling means 33. Since the lever is constantly spring-biased 32, the guiding element 3, 4 is reliably locked so that the reeling device 7 cannot unintentionally run downwards within the guiding element. At the same time this embodiment guarantees that during the tentering procedure, the bar 5 can pass the lever 31 without any problem, since the lever 31 moves independently into the direction of the arrow x when it passes the bow 5, since it protrudes angularly into the guiding element 3, 4.

Figure 9A:
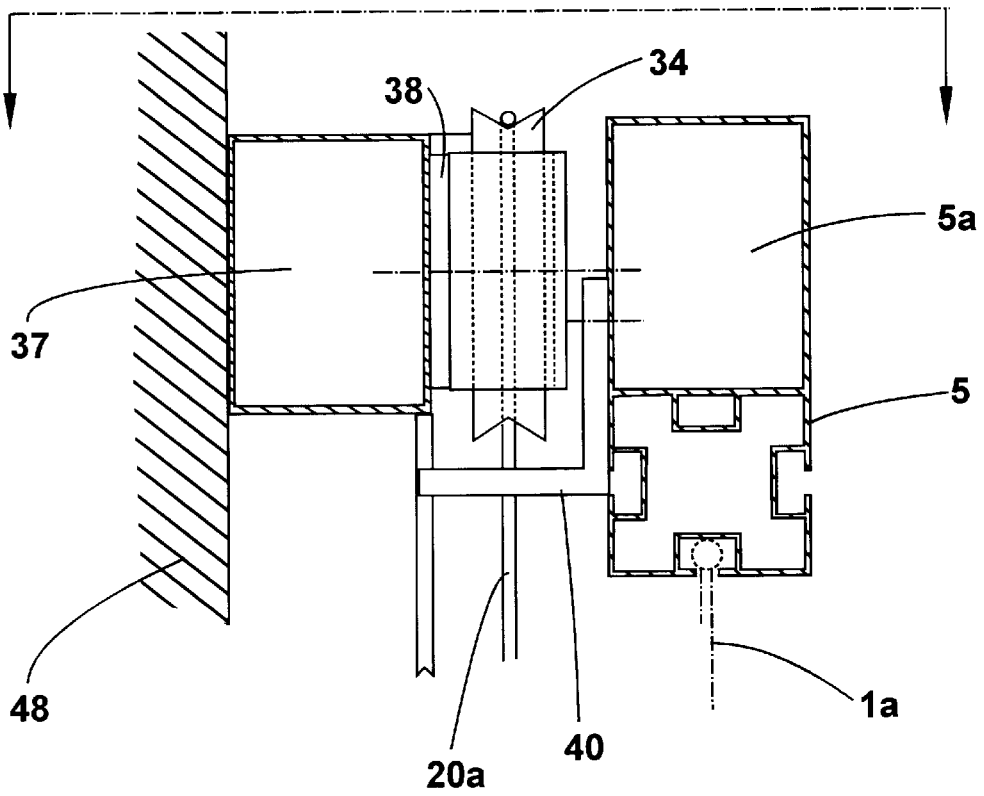
FIG. 9*a*.
Figure 9B:
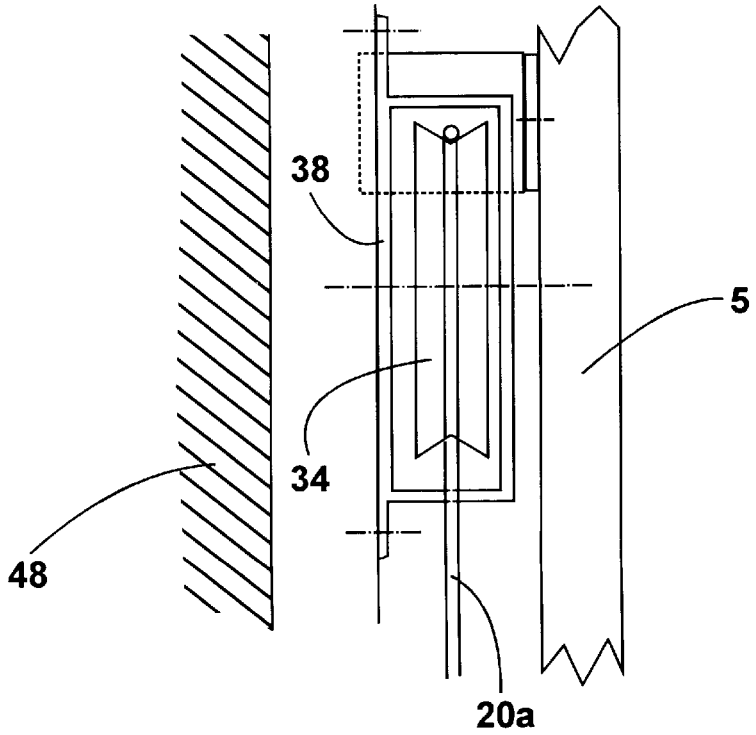
FIG. 9*b* is a section along the line IX—IX of FIG. 5 in a different projection.
Figure 10A:
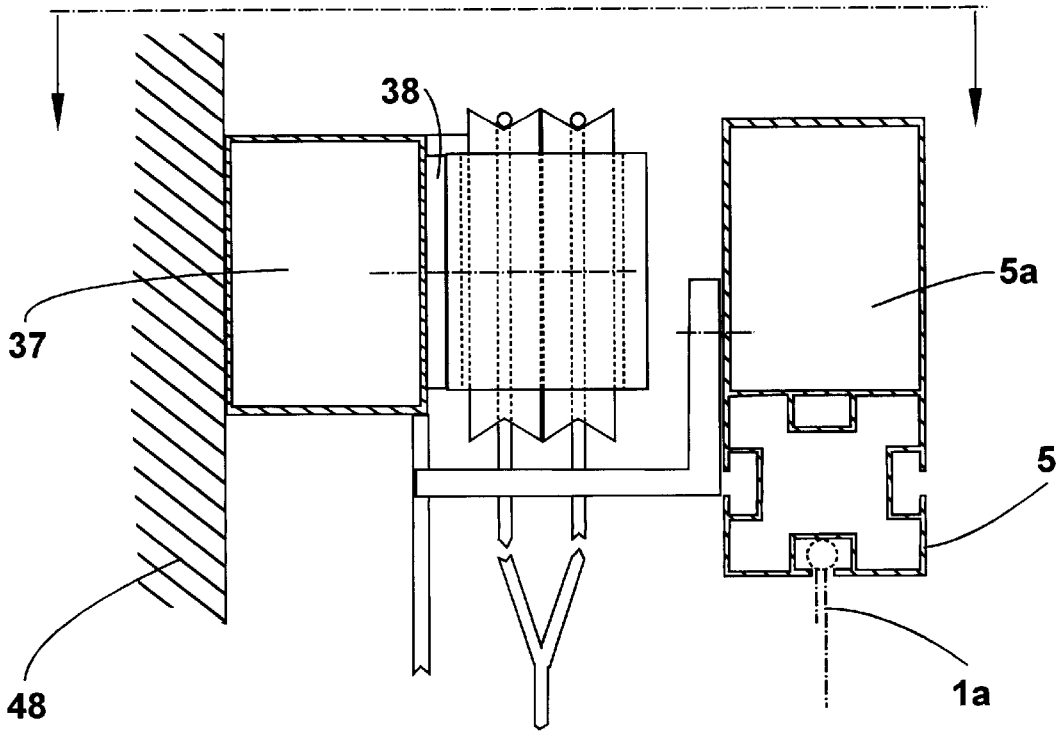
FIG. 10*a*.
Figure 10B:
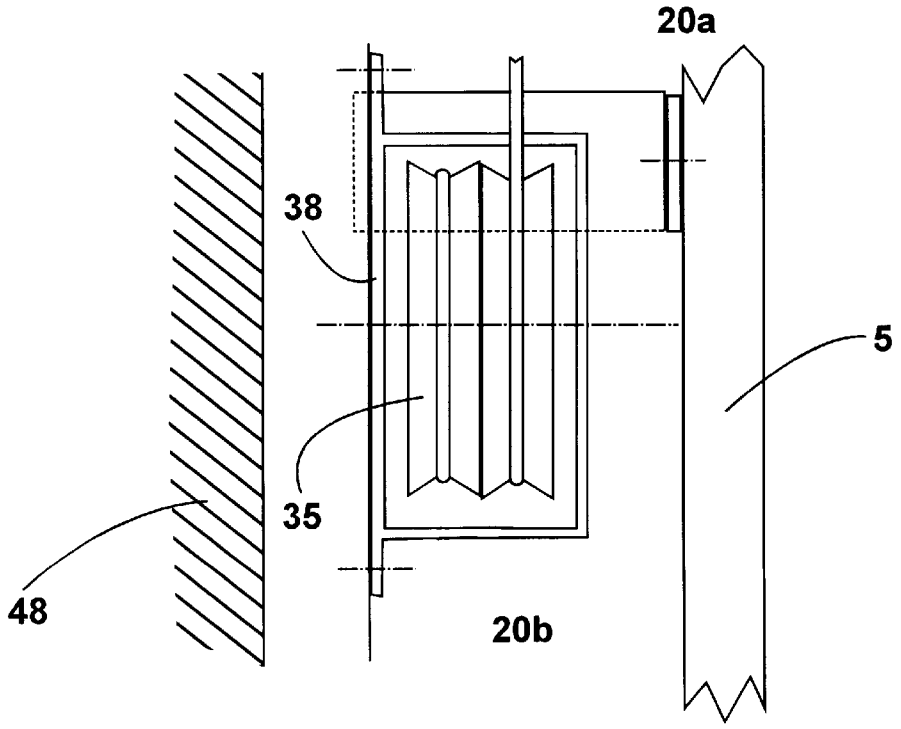
FIG. 10*b* is a section along the line X—X of FIG. 5 in a different projection.
Figure 11:
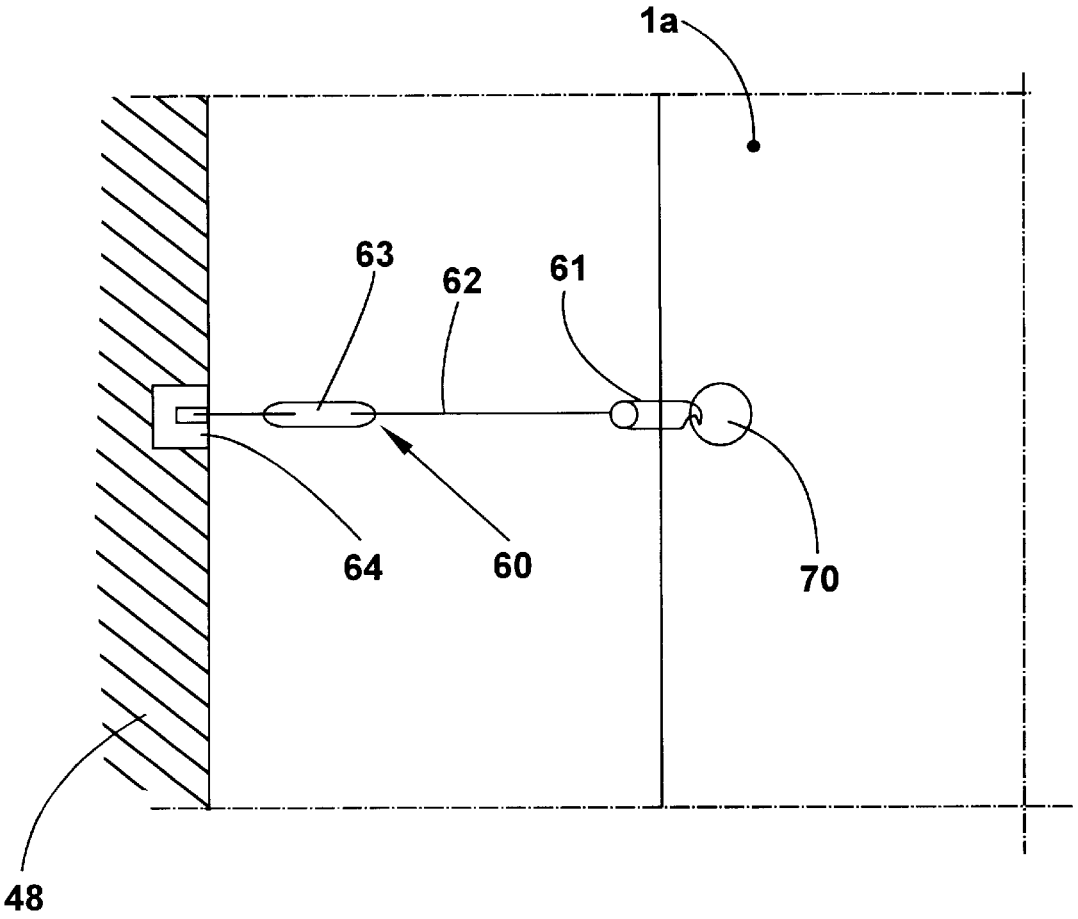
FIG. 11 is a top view of the tentering means preventing the advertising carrier from contracting.

The location of the reels 34, 35 used to hoist the bar 5 onto the wall so that it can receive the device can particularly be seen in FIGS. 9*a* and 9*b* and 10*a* and 10*b*. Hereby, the FIGS. 9*a*, 9*b* show the location of the reel 34. On the wall 48 that receives the whole device 1 a square profile 37 is provided together with a housing 38 for a rotary reception of the reel 34. An angle 40 connects the bar 5 and the cleat 5*a* of the bar 5 with the reeling device 7.

The reel 35 itself and the location of the reel 35 differs from the reel 34 by being designed as a double-groove reel. Since the bar 5 is hoisted on two points, namely in the area of the reel 34 and in the area of the reel 35 itself, two cables 20*a*, 20*b* are in principle necessary. A first cable 20*a*, which is connected with the bar in the area of the reel 34, and a second cable 20*b*, which is connected in the area of the double-groove reel 35 with the bar 5. Both cables are joined into one cable 13 after deflection by the reel 35, the cable 13 being connected with the cable winch 12. It is also possible to design the reel 35 as a simple reel, if the track, that means the groove, is wide enough to guide two cables.

With wide advertising carriers, such as foils or tarpaulins of 6 m width for example, the advertising carrier contracts on its long sides. In order to avoid this, the advertising carrier is provided laterally with tentering means 60. The tentering means 60 comprise a trigger snap 61 to be snapped into a corresponding eye 70 in the advertising carrier, whereas the trigger-snap 61 is connected with a turnbuckle 63 via a cable 62, whereas the turnbuckle 63 is fastened onto a holding device 64 placed onto the wall 48.

We claim:

1. Device for accommodating a planiform advertising carrier made of foil, said device comprising a frame including an upper bar and a lower bar, for attachment to an advertising carrier which is tenterable upwardly and downwardly between the two bars by a tentering device, said two bars being, relative to each other, movably accommodated by two guiding elements, and said lower bar being kept tentered against an upper tentering direction force by means of a spring-loaded stopper and laterally extending tentering means for keeping the advertising carrier laterally tentered to prevent contraction of the advertising carrier.

2. Device according to claim 1, characterized in that the bars (5, 6) are horizontally receivable by the frame (2).

3. Device according to claim 1, characterized in that the tentering device (11) comprises a cable winch, which is connected with the upper bar (5).

4. Device according to claim 1, characterized in that the upper bar (5) has a reeling device (7) and the reeling device is guided movably on the guiding elements (3,4).

5. Device according to claim 1 comprising securing means (16, 30) for securing said upper bar (5) when an advertising carrier is tentered in said device.

6. Device according to claim 5, characterized in that a stopper (21) is provided for the other lower bar (6).

7. Device for accommodating a planiform advertising carrier made of foil, said device comprising an upper bar and a lower bar, the advertising carrier accommodated thereby being tenterable upwardly and downwardly between said two bars, said two bars being, relative to each other, movably accommodated by two guiding elements, securing means being provided for securing the upper bar when an advertising carrier is tentered in said device, said lower bar being kept tentered against an upper tentering direction force by means of a spring-loaded stopper and said securing means (16) comprising a spring-loaded bolt (18) which can be brought into removable interaction with the upper bar (5).

8. Device according to claim 7, characterized in that the bar (5) has an eye (19) provided with an oblique inlet (19*a*) for the receiving the bolt (18).

9. Device for accommodating a planiform advertising carrier made of foil, said device comprising an upper bar and a lower bar, the advertising carrier accommodated thereby being tenterable upwardly and downwardly between said two bars, said two bars being, relative to each other, movably accommodated by two guiding elements, securing means being provided for securing the upper bar when an advertising carrier is tentered in said device, said upper bar (5) having a reeling device which is movably guided on the guiding elements (3, 4) and said securing means (30) comprising a lever (31) which is pivotable into the guiding elements (3, 4) for preventing the reeling device (7) and the upper bar (5) from unintentionally running downwards.

10. Device according to claim 9, characterized in that the lever (31) is biased by a spring (32).

11. Device according to claim 9, characterized in that the lever (31) is pullable out of the guiding elements (3, 4) by pulling means (33) against the force of a spring (32).

* * * * *

UNITED STATES PATENT AND TRADEMARK OFFICE

CERTIFICATE OF CORRECTION

PATENT NO. : 5,941,001

DATED : August 24, 1999

INVENTOR(S) : Thomas Dietrich, Rainer Kunze and Michael Lazar

It is certified that error appears in the above-indentified patent and that said Letters Patent is hereby corrected as shown below:

Column 01, line 09, "bows" s/b --bars-- (both occurences);
Column 01, line 40, "bows" s/b --bars-- (both occurences);
Column 01, line 42, "bows" s/b --bars--;
Column 01, line 44, "bows" s/b --bar --;
Column 01, line 46, "bow" s/b --bar--;
Column 01, line 49, "bow" s/b --bar--;
Column 01, line 59, "bows" s/b --bars--;
Column 01, line 60, "bows" s/b --bars--;
Column 01, line 64, "bow" s/b --bar--;
Column 01, line 66, "bow" s/b --bar--;
Column 01, line 67, "bow" s/b --bar--;
Column 02, line 02, "bow" s/b --bar--;
Column 02, line 03, "bow" s/b --bar--;
Column 02, line 07, "bows" s/b --bars--;
Column 02, line 11, "bows" s/b --bars--;
Column 02, line 13, "bows" s/b --bars--;
Column 02, line 16, "bows" s/b --bars--;
Column 02, line 17, "bow" s/b --bar--;
Column 02, line 19, "bows" s/b --bars--;
Column 02, line 19, "bow" s/b --bar--;
Column 02, line 20, "bow" s/b --bar--;
Column 02, line 25, "bows" s/b --bars--;

UNITED STATES PATENT AND TRADEMARK OFFICE

CERTIFICATE OF CORRECTION

PATENT NO. : 5,941,001 
DATED : August 24, 1999
INVENTOR(S) : Thomas Dietrich, Rainer Kunze and Michael Lazar It is certified that error appears in the above-identified patent and that said Letters Patent is hereby corrected as shown below:

Column 02, line 27, "bow" s/b --bar--(both occurences);
Column 02, line 30, "bow" s/b --bar--;
Column 02, line 33, "bow" s/b --bar--;
Column 03, line 56, "bow" s/b --bar--.

Signed and Sealed this

Seventeenth Day of October, 2000

*Attest:*

Q. TODD DICKINSON

*Attesting Officer*

*Director of Patents and Trademarks*